United States Patent [19]

Blasio et al.

[11] 4,273,611

[45] Jun. 16, 1981

[54] METHOD FOR TREATING A SPENT EMULSION OF OIL IN WATER USED IN AN INDUSTRIAL PROCESS, AND THE APPARATUS FOR CARRYING OUT THE METHOD

[75] Inventors: Pietro Blasio, Florence; Maurizio Talini, Lucca, both of Italy

[73] Assignee: Le Metalli Industrialle S.p.A., Florence, Italy

[21] Appl. No.: 61,256

[22] Filed: Jul. 27, 1979

[30] Foreign Application Priority Data

Jan. 30, 1979 [IT] Italy ..... 67196 A/79

[51] Int. Cl.[3] ..... B01D 1/00

[52] U.S. Cl. ..... 159/47 WL; 159/1 S; 159/DIG. 39; 208/187; 203/DIG. 1; 202/234; 126/225

[58] Field of Search ..... 159/1 S, 1 C, 4 R, 23, 159/47 WL, 48 R, DIG. 10; 203/DIG. 1; 202/234, 235, 176; 208/187, 188; 126/225

[56] References Cited

U.S. PATENT DOCUMENTS

| | | | |
|---|---|---|---|
| 1,933,254 | 10/1933 | Goodell | 159/47 WL |
| 3,352,693 | 11/1967 | Berk | 159/48 L |
| 3,394,054 | 7/1968 | Hoham | 202/234 |
| 4,104,112 | 8/1978 | Stutz | 159/4 R |

*Primary Examiner*—Norman Yudkoff

*Attorney, Agent, or Firm*—Merriam, Marshall & Bicknell

[57] ABSTRACT

A method for treating a spent emulsion of oil in water used in an industrial process, in particular an emulsion of cutting oil in water is described.

The method comprises at least one stage in which heat energy is supplied continuously to said emulsion for evaporating a predetermined quantity of the water contained therein and to raise the concentration of said oil in the emulsion to a value such as to enable this latter to be burnt in an industrial burner, said heat energy being at least partly provided by utilizing solar energy, and further comprises at least one stage of burning the emulsion of said oil concentration in a burner in an industrial or heating plant.

5 Claims, 3 Drawing Figures

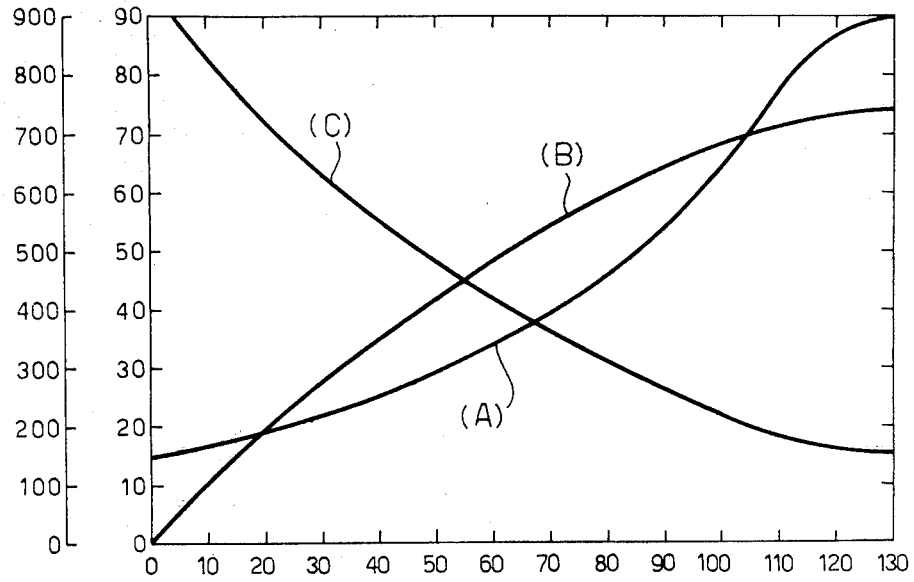
Fig.2
Fig.3
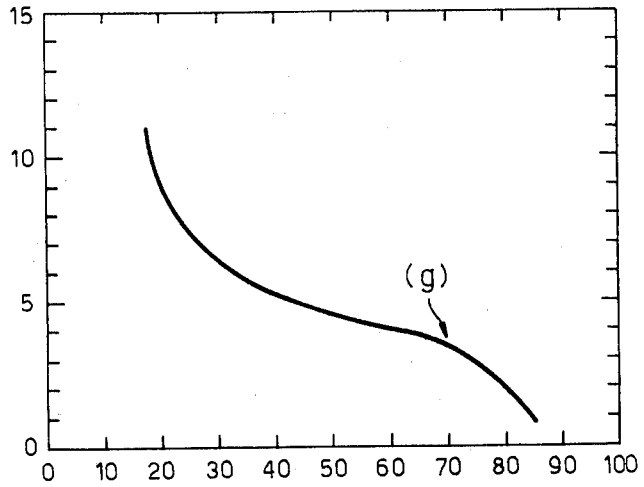

METHOD FOR TREATING A SPENT EMULSION OF OIL IN WATER USED IN AN INDUSTRIAL PROCESS, AND THE APPARATUS FOR CARRYING OUT THE METHOD

BACKGROUND OF THE INVENTION

This invention relates to a method for treating a spent emulsion of oil in water used in an industrial process, in particular an emulsion of cutting or rolling oil in water. With the method according to the invention it is possible to recover oil from the emulsion for energy production purposes, and discharge of the emulsion or its components into the external environment is prevented.

In numerous industrial processes, emulsions of various oils in water are used both for cooling and lubricating the semi-finished products being machined, the tools or machine parts. In particular, emulsions of cutting oil in water are widely used in nearly all mechanical chip-forming machining to reduce the cutting force between the tool and the piece being machined, and to cool both of these during machining.

When the quantity of foreign substances such as swarf, dust and the like becomes particularly high in said emulsions, they are no longer suitable for industrial use. The disposal of such spent emulsions creates serious ecological and energy problems, because they are a source of serious pollution whether they are discharged into the external environment or are treated in various ways to separate some of their components.

Some treatment methods for spent emulsions are known for separating the oil contained in them from the other components, or for allowing them to be used for energy production purposes.

Such treatment is substantially of two types. The first type of treatment, using suitable chemcial agents and applying heat, tend firstly to separate water from the components of greater density and then the oils from these latter. Treatment of this type comprises firstly the addition of an acid or polymer to the emulsion, then suitable quantities of aluminium to flocculate the higher density components and form sludge. The oil is then separated from the sludge by heating and by the addition of suitable additives.

The second type of treatment involves using the emulsion directly in suitable liquid fuel burners by adding a sufficient quantity of fuel to it to give a mixture which can burn in the burner.

The first type of treatment has the drawback of requiring the use of additives of rather high cost to flocculate the higher density components of the emulsion (acids and aluminium), and the use of high quantities of energy for heating the emulsion and the sludge. In addition, such treatment comprises numerous rather complicated processing stages.

The second type of treatment requires the use of very high quantities of liquid fuel to be added to the emulsions to make them burnable. Moreover, the heat energy produced in this manner is difficult to use for industrial purposes, and fumes are generated during combustion which are a source of environmental pollution.

SUMMARY OF THE INVENTION

The object of the present invention is to provide a method for treating a spent emulsion of the described type, by means of which it is possible to obviate the drawbacks connected with discharging the emulsion into the external environment and with its treatment for separating certain of its components.

A further object of the present invention is to provide a method for treating a spent emulsion of the initially described type by means of which at least part of the components forming the emulsion can be further used for energy production purposes.

A further object of the invention is to provide an apparatus suitable for carrying out the method according to the invention.

The present invention provides a method for treating a spent emulsion of oil in water used in an industrial process, in particular an emulsion of cutting oil in water, comprising at least one stage in which heat energy is supplied continuously to said emulsion for evaporating a predetermined quantity of the water contained therein and to raise the concentration of said oil in the emulsion to a value such as to enable this latter to be burnt in an industrial burner, said heat energy being at least partly provided by utilising solar energy, and further comprising at least one stage of burning the emulsion of said oil concentration in a burner in an industrial or heating plant.

The present invention also provides an apparatus for treating a spent emulsion of the aforesaid type, characterised by comprising heating means for said emulsion for supplying it with heat energy which is generated at least partly from solar energy, and evaporation means for evaporating at least part of said water contained in said emulsion, which is heated by said heating means, to increase the concentration of said oil in the emulsion to a value such as to make it burnable in an industrial burner; said heating means conveniently comprising at least one solar energy collector.

BRIEF DESCRIPTION OF THE DRAWINGS

The method of the present invention will be more apparent from the detailed description given hereinafter of its main stages and of one embodiment of the apparatus for carrying out the method, with reference to the accompanying drawings in which:

FIGS. 2 and 3 are diagrams showing experimental results obtained using the apparatus of the previous figure.

DETAILED DESCRIPTION OF THE INVENTION

Figure 1:
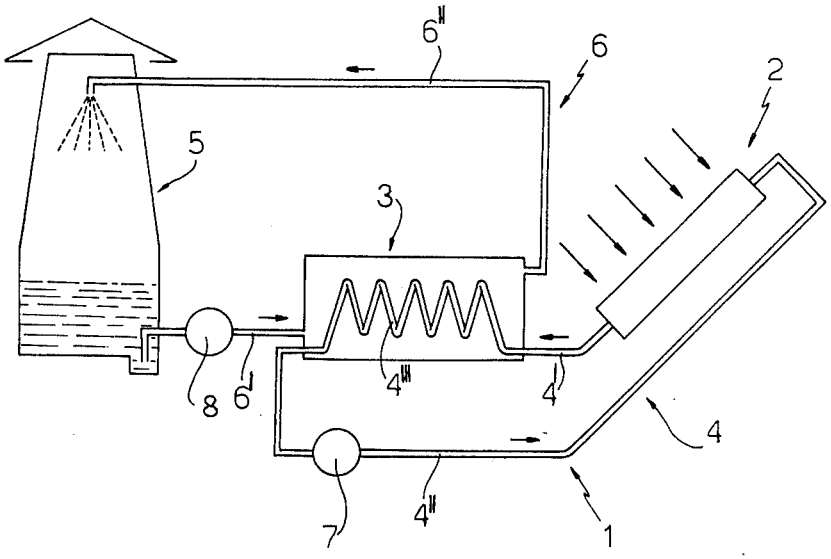
FIG. 1 is a diagrammatic view of the basic elements making up the apparatus for carrying out the method of the invention.

Before describing the various stages in the method of the present invention, the apparatus of FIG. 1 with which the method of the invention can be carried out will firstly be examined.

This apparatus is suitable for treating a spent emulsion of oil in water or of any mixture of such oil in water, of the type used in industrial processes. In particular, it is suitable for treating an emulsion of cutting or rolling oil in water as used in mechanical chip-forming machining on machine tools, or in rolling or drawing processes.

The apparatus of FIG. 1 substantially comprises emulsion heating means for supplying the emulsion with a predetermined quantity of heat generated by at least partly utilising solar energy. The said heating means, indicated by 1, substantially comprise at least one energy collector 2 and a heat exchanger 3 for receiving a certain quantity of heat from the collector 1. A circuit can be conveniently provided for this purpose, indicated by 4 in FIG. 1, to connect the collector 2 to the heat exchanger 3 and comprising pipe portions 4', 4'' and 4''' through which a suitable fluid such as water flows, and which hydraulically connect the collector outlet to the heat exchanger inlet and the heat exchanger outlet to the collector inlet, so forming a closed circuit through which water can continuously circulate to transfer to the heat exchanger the heat energy produced in the collector by solar radiation.

The apparatus of the invention also comprises evaporation means indicated overall by 5, for evaporating at least part of the water contained in the emulsion. Said means are connected to the heat exchanger 3 by way of a closed circuit indicated by 6, so as to provide continuous circulation between the heat exchanger and evaporation means so as to feed the evaporation means with the emulsion after it has been heated in the heat exchanger 3. For this purpose, the circuit 6 can conveniently comprise pipe portions 6' and 6'', the first of which connects the outlet of the evaporation means 5 to the heat exchanger 3 and the second connects the outlet of the heat exchanger 3 to the inlet of the evaporation means 5.

Said evaporation means can conveniently consist of a normal evaporation tower of any known type, for example of the type in which an emulsion is circulated through an air environment and is possibly made to fall, in the form of a spray, through an air stream.

Pumps, 7 and 8, can be provided in the circuits 4 and 6 respectively for circulating the heating fluid between the collector 2 and heat exchanger 3, and the emulsion between this latter and the evaporation means 5.

The method of the invention as carried out using the apparatus described takes place in the following manner.

The evaporation tower 5 is filled with a predetermined quantity of spent emulsion which is no longer suitable for utilisation in the industrial process in which it has been used. This then circulates continuously around the circuit 6 and tower 5 under the action of the pump 8. At the same time, solar energy striking the collector 2 heats the heating fluid in the circuits 4, which is circulated through this circuit by the pump 7, so as to provide the exchanger 3 with a certain quantity of heat. This is transferred to the emulsion circulating in the circuit 6, by the heat exchange which takes place inside the heat exchanger 3.

In this manner, the heated emulsion reaches the evaporation tower 5 at a certain temperature. The water contained in the emulsion evaporates in this, the heat of evaporation being derived from the quantity of heat present in the emulsion. The emulsion leaving the evaporation tower has a smaller water concentration and a lower temperature than that entering the tower. The emulsion is then again fed to the heat exchanger 3 to be again heated.

It is apparent that as the emulsion circulates through the circuit 6 and the evaporation tower 5, its oil concentration increases. This oil enrichment takes place substantially without supplying it with any energy other than the solar energy received through the collector 2.

By continuing with the treatment, the concentration of the oil in the emulsion can be raised to a very high level, even of the order of 90%. The concentration considered most suitable for the objects of the method is at least that which makes it able to be burnt in a normal industrial burner. It has been found that a concentration of 70 to 80% of oil in the emulsion makes it suitable for this application. Consequently, when such a concentration is reached, and which as will be seen hereinafter can be reached in a suitably dimensioned plant by operating the equipment for about 100 hours (in terms of the duration of effective exposure of the collectors to the solar energy), the treated emulsion can be discharged from the equipment.

The method of the invention comprises the further stage of burning the treated emulsion in a normal burner of an industrial or heating plant. In this manner the emulsion can be used as a normal liquid fuel for the production of heat energy as a replacement for a fuel oil, so as to substantially utilise its entire heat of combustion for energy production purposes. Alternatively it can be added to a fuel oil to be burnt together therewith.

It is therefore apparent that two objects are fundamentally attained by the treatment to which the emulsion is subjected based on the method of the present invention, namely the disposal of the emulsion without polluting the external environment, and completely recovering the heat of combustion of the most valuable components of the emulsion by making it burnable in a normal burner. These objects are attained without energy consumption other than the use of solar energy alone.

FIGS. 2 and 3 show experimental results obtained from the operation of an apparatus of the type shown in FIG. 1.

FIG. 2 shows three graphs illustrating the variation of oil content in the emulsion circulating through the evaporation tower 5 and circuit 6 (curve A), the variation in the quantity of water evaporated from the emulsion (curve B) and the variation in the total volume of the emulsion (curve C), all as a function of the number of hours of operation.

The data for these diagrams are obtained from tests carried out on an initial volume of emulsion 900 liters having an oil concentration of 15.7%. As can be seen from curve A, after an operating time of about 130 hours, a final oil concentration in the emulsion of 90% is obtained, and its final volume is reduced to about 150 liters. This curve also shows that the rate of oil enrichment in the emulsion tends to increase as the operating time of the plant increases, the rate of enrichment being fairly low at the beginning and tending to increase substantially towards the end of the treatment, as shown by the greater slope of the final portion of curve A.

As shown by curve B, the rate of evaporation of the water tends to decrease substantially uniformly as the time of treatment increases, as can be seen by the reduction in the slope of curve B, this reduction being substantially uniform along the entire curve.

The diagram of FIG. 3 shows the variation in the rate of evaporation of the water (in liters/hour) as a function of the oil concentration. As this curve shows, whereas there is a high evaporation rate at low oil concentrations (up to a concentration of about 30%), the evaporation rate tends to decrease at higher concentrations. When an oil concentration of about 70% is reached, a sharper reduction in the evaporation rate begins, and this tends to increase over the entire final portion of the curve of FIG. 2 beyond the inflection g on the curve. From an examination of this behaviour, it can therefore be concluded that it is convenient to proceed with the oil concentration in the emulsion only up to a value of about 70%, because beyond this value any further increase in the oil concentration of the emulsion can be obtained only by a relatively long treatment time due to the sharp and considerable reduction in the rate of evaporation of water from the emulsion. However, an oil concentration of 70% means that the emulsion is completely suitable for the next stage of the process (combustion in a burner), and the method according to the invention can therefore be stopped on attaining said oil concentration. It has been found that an emulsion with an oil concentration of 70% has a heat of combustion of about 6000 kcal/kg, and can therefore constitute a true liquid fuel.

It is apparent that modifications can be made to the various stages of the process as described and to the various components of the apparatus for carrying out the process, without leaving the scope of the invention.

What we claim is:

1. A method for treating a spent emulsion of oil in water used in an industrial process, in particular an emulsion of cutting oil in water, comprising at least one stage in which heat energy is supplied continuously to said emulsion for evaporating a predetermined quantity of the water contained therein and to raise the concentration of said oil in the emulsion to a value such as to enable this latter to be burnt in an industrial burner, said heat energy being at least partly provided by utilising solar energy, and further comprising at least one stage of burning the emulsion of said oil concentration in a burner in an industrial or heating plant.

2. A method as claimed in claim 1, wherein said heat energy is supplied to said emulsion by a heat exchanger aranged to receive this heat energy from one or more solar energy collectors and to transfer it to said emulsion.

3. A method as claimed in claim 1, wherein said evaporation of said quantity of water is carried out in an evaporation device arranged to evaporate water from said heated emulsion, said evaporation device being connected to said heat exchanger by means of a first hydraulic circuit in such a manner as to provide continuous circulation emulsion between said evaporator and said heat exchanger.

4. A method as claimed in claim 3, wherein said evaporation device is an evaporation tower in which said emulsion falls, in the form of a spray, through an air stream.

5. A method as claimed in claim 1, wherein said heat energy is transferred from said solar collector to said heat exchanger by using a liquid circulating through a second hydraulic circuit which connnects said collector to said heat exchanger.

* * * * *